US005887347A

United States Patent [19]

Gibbs

[11] Patent Number: 5,887,347

[45] Date of Patent: Mar. 30, 1999

[54] COMPACT FOLDING BLADE KNIFE WITH BLADE LOCKING FEATURE

[75] Inventor: Philip W. Gibbs, Camillus, N.Y.

[73] Assignee: Camillus Cutlery Co., Camillus, N.Y.

[21] Appl. No.: 951,320

[22] Filed: Oct. 16, 1997

[51] Int. Cl.[6] ..... B26B 1/04

[52] U.S. Cl. ..... 30/161; 030/155

[58] Field of Search ..... 030/160, 161, 030/164, 155

[56] References Cited

U.S. PATENT DOCUMENTS

| | | | |
|---|---|---|---|
| 4,805,303 | 2/1989 | Gibbs | 30/161 |
| 5,331,741 | 7/1994 | Taylor, Jr. | 30/161 |
| 5,461,786 | 10/1995 | Miller | 30/161 |
| 5,511,310 | 4/1996 | Sessions et al. | 30/161 |

*Primary Examiner*—Hwei-Siu Payer
*Attorney, Agent, or Firm*—George R. McGuire

[57] ABSTRACT

A hand tool, e.g., a knife, includes a handle with a pair of spaced cover pieces, at least one blade or other implement pivotally attached to the handle for movement with respect thereto between folded and extended positions, a locking lever for maintaining the blade in the extended position until manually released, and a beam spring urging the lever toward the locking position. The tool also includes a liner in the form of a flat, metal plate affixed to one of the cover pieces within a recess closely surrounding the periphery of the liner and having a depth substantially equal to the liner's thickness. The beam spring is an integral part of the liner, being formed by a slotted or cut-away area providing an elongated arm integrally connected at one end to a body portion and having an opposite, terminal end portion extending laterally to bear against the locking lever.

14 Claims, 4 Drawing Sheets

28
38
56
24
14
43
52
54
30
32
46
48
50
44
34
26
42
40
36
16

COMPACT FOLDING BLADE KNIFE WITH BLADE LOCKING FEATURE

BACKGROUND OF THE INVENTION

The present invention relates to knives or similar tools having a handle and one or more blades or other implements pivotally movable between folded and extended positions with respect to the handle, and means for releasably locking each implement in the fully open position. More specifically, the invention relates to improvements in the design of tools having pivoted, lockable implements and featuring a unitary liner-beam spring element mounted in a recess on the inner side of a molded cover piece of the handle.

U.S. Pat. Nos. 4,805,303 and 5,044,079, both of the present inventor, disclose multi-blade, folding knives of the so-called lockback type. When a blade of such knives is pivoted to the fully open position, a pivotally mounted locking member is moved by the biasing force of a beam spring into mechanically locking engagement with a notch in the blade to prevent movement away from this position until the locking member is manually rotated against the biasing force of the beam spring. The knives of both patents include metal liners mounted in face-to-face engagement with the inner opposing surfaces of the handle cover pieces for purposes of strength and rigidity.

The locking feature of the knives of the aforementioned patents, as well as other prior art knives of this type, while desirable for safety purposes, adds to the number of parts, and thus to the cost of both parts and assembly. Also, knives or similar tools having lockback features are generally larger and heavier than their non-locking counterparts.

Accordingly, it is a principal object of the present invention to provide a folding knife, or similar hand tool, with lockback features which is generally smaller, lighter and more economical in both materials and assembly costs than prior art tools having such features.

Another object is to provide a hand tool having at least one implement movable with respect to a handle between folded and extended positions, and a spring biased locking member preventing movement of the implement away from the extended position until released, wherein a relatively large implement is accommodated by a relatively small handle. That is, the blade or other folding implement is larger relative to the handle than prior art folding tools with lockback features.

Other objects will in part be obvious and will in part appear hereinafter.

SUMMARY OF THE INVENTION

The tool of the present invention, as in prior art tools of the same general type, includes a handle and one or more blades or other implements pivotally movable with respect to one end of the handle between folded and extended positions, a pivoted locking member and a beam spring. The spring biases the locking member toward engagement with the blade to prevent movement thereof away from the fully extended or unfolded position while the locking member is engaged therewith. Manual pressure on the locking member moves it, against the biasing force of the spring, out of engagement with the blade, permitting the latter to pivot back to its folded position.

The tool of the present invention includes all of the above-described features. However, the beam spring, rather than being a separate element fixedly mounted upon another part of the tool, is physically incorporated in the liner, a flat, metal strip mounted on the inner side of one of the handle cover pieces to provide strength and rigidity. In the disclosed embodiment the handle covers are molded plastic parts at least one of which includes a recess having a depth substantially equal to the thickness of the liner on its inner side. The recess and liner have the same peripheral configurations, whereby the inwardly facing surface of the liner and the surrounding portion of the handle cover surface are essentially coplanar.

The foregoing and other features of construction and operation of the hand tool of the invention will be more readily understood and fully appreciated from the following detailed disclosure taken in conjunction with the accompanying drawings.

DETAILED DESCRIPTION

Figures 1, 2:
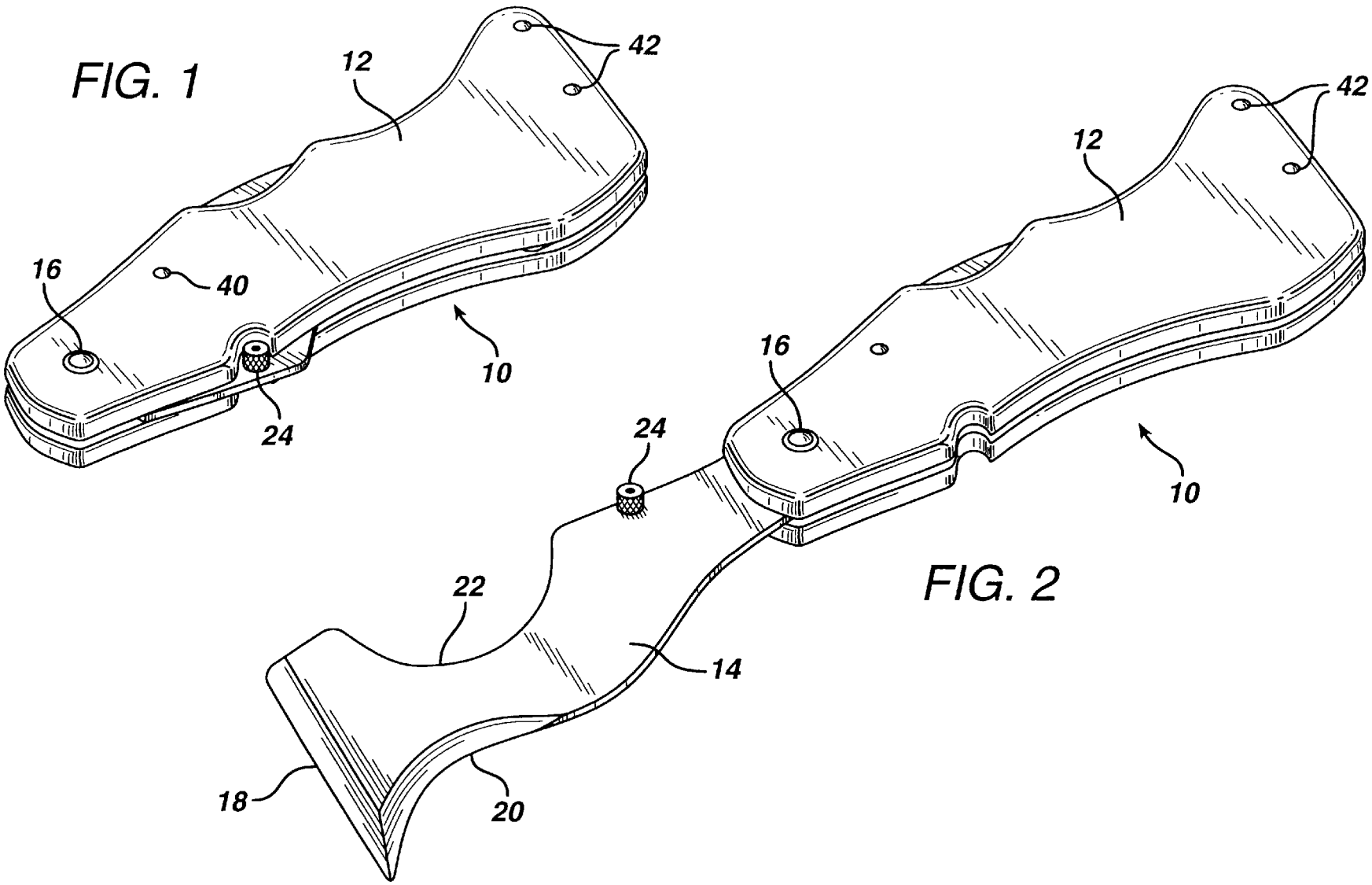
FIG. 1 is a perspective view of a folding tool incorporating the present invention, shown with the folding implement in the folded position.
FIG. 2 is a perspective view of the tool of FIG. 1 with the implement in the extended position.

Referring now to the drawings, a hand tool of the folding type incorporating the invention is denoted generally in FIGS. 1 and 2 by reference numeral 10. Tool 10 includes a handle portion 12 and an implement 14 movable about an axis through pin 16, by which implement 14 is pivotally connected to handle portion 12, between folded and extended positions shown in FIGS. 1 and 2, respectively. Implement 14 may be a knife blade or other item conventionally provided in such folding tools, or may be specially designed to perform desired functions. The illustrated implement 14, for example, is intended for use in painting applications, having edges 18, 20, 22 designed for scraping surfaces, cleaning brushes, etc. Although referred to for convenience herein as a blade, it will be understood that the particular form or intended function of implement 14 is of no consequence to the present invention. Knurled knob 24 is affixed to blade 14 for ease of movement thereof away from the folded position, this being another feature with which the invention is not concerned.

Figure 3:
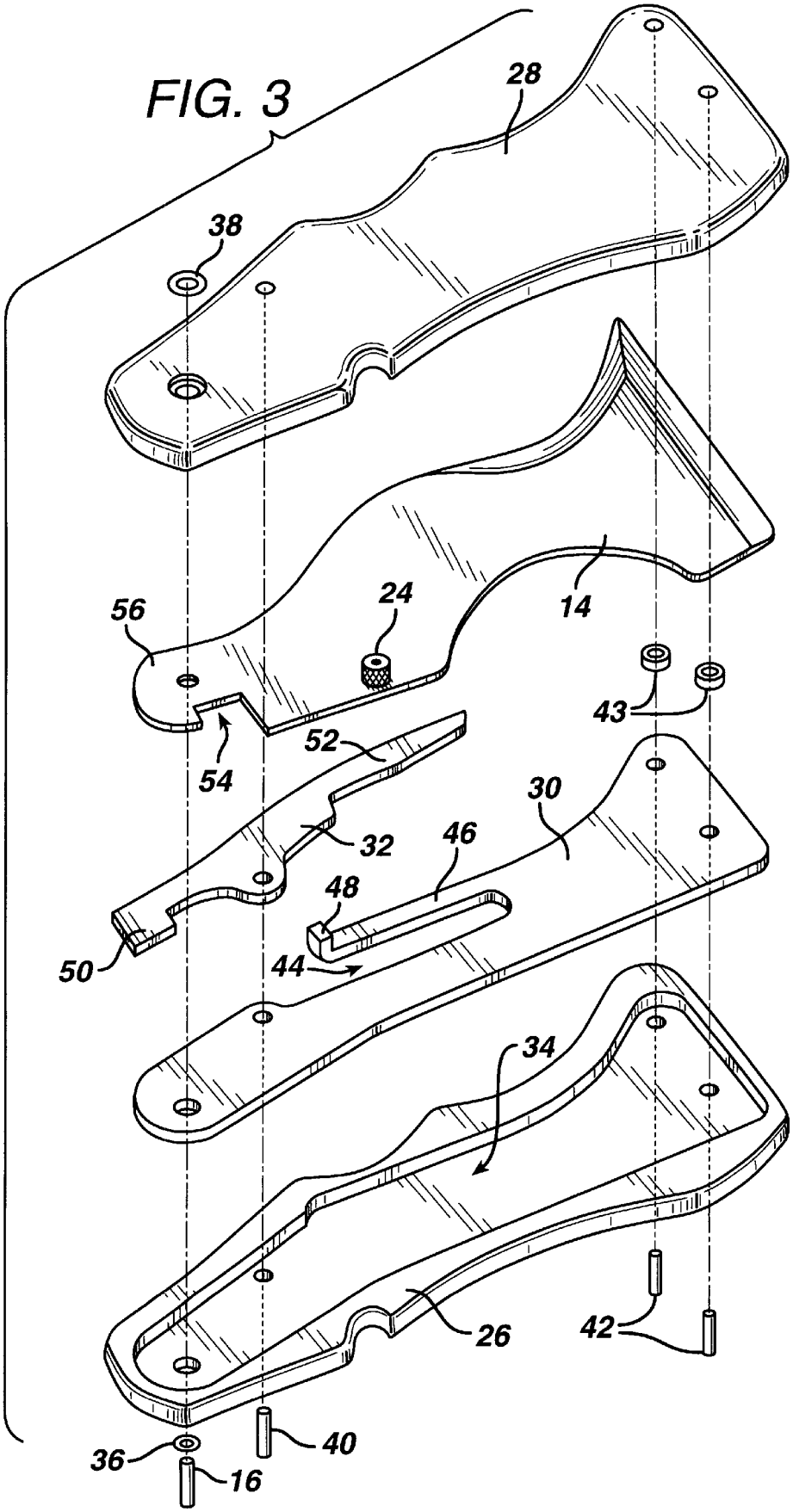
FIG. 3 is an exploded perspective view showing separately each element of the tool.

In FIG. 3, handle portion 12 is seen to include two cover pieces 26 and 28 which may be conveniently and economically molded from an appropriate, rigid plastic material. In addition to blade 14 and handle covers 26 and 28, tool 10 includes only two other parts, namely, liner 30 and locking lever 32. Liner 30 fits closely within the periphery of recess 34 of handle cover 26 and has a thickness substantially equal to the depth of the recess, whereby the inwardly exposed surface of the liner is substantially co-planar with the surrounding, inner surface of the cover piece. Pin 16 passes through openings in cover 26, liner 30, blade 14 and cover 28, and is secured by lock washer 36 and 38. Pin 40 passes through openings in cover 26, liner 30, locking lever 32 and cover 28, serving as a pivotal mounting for the locking lever. Pins 42 secure cover 26 to liner 30, and covers 26 and 28 to one another, passing through washers 43 which provide the proper spacing between opposing surfaces of cover 28 and liner 30.

Liner 30 is slotted at area 44 to provide integral, cantilevered portion 46 which serves as a beam spring with laterally extending, terminal end 48. Locking lever 32 includes, on opposite sides of its pivotal mounting on pin 40, square-sided tab 50 and manually engageable portion 52. Slot 54 in blade 14 adjacent the pivotal mounting thereof is of slightly larger dimensions than tab 50.

Figure 4:
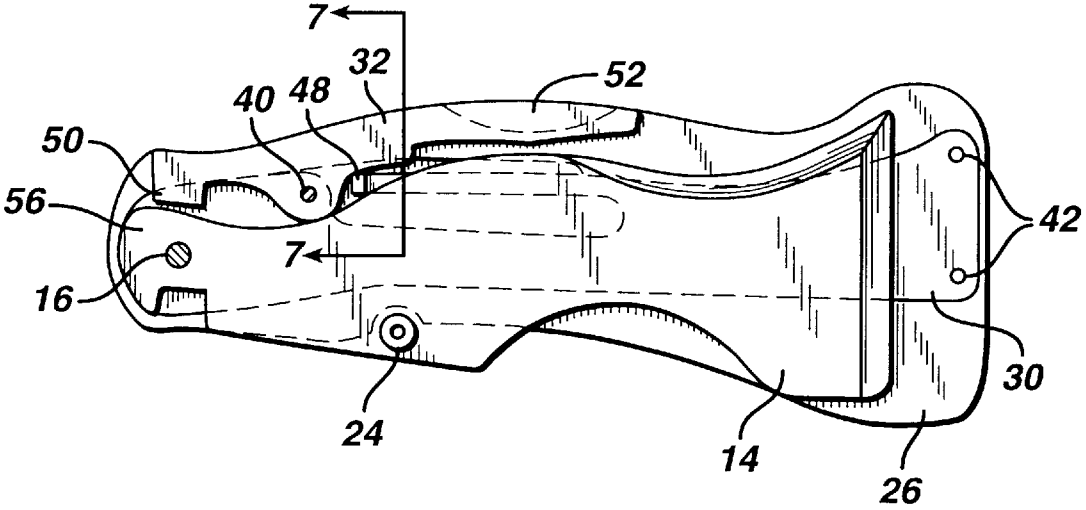
FIGS. 4–6 are side elevational views with the handle cover on the facing side removed, showing certain elements in three positions of relative movement.

As seen in FIG. 4, when blade 14 is in the folded position, tab 50 of locking lever 32 bears against portion 56 of the blade. The relative shapes and positions of the elements are such that terminal end 48 of liner portion 46 extends under and bears against locking lever 32. The beam spring is flexed slightly from its rest position, urging locking lever 32 toward counter-clockwise rotation and maintaining blade 14 in the folded position by virtue of tab 50 bearing against blade portion 56.

Figure 5:
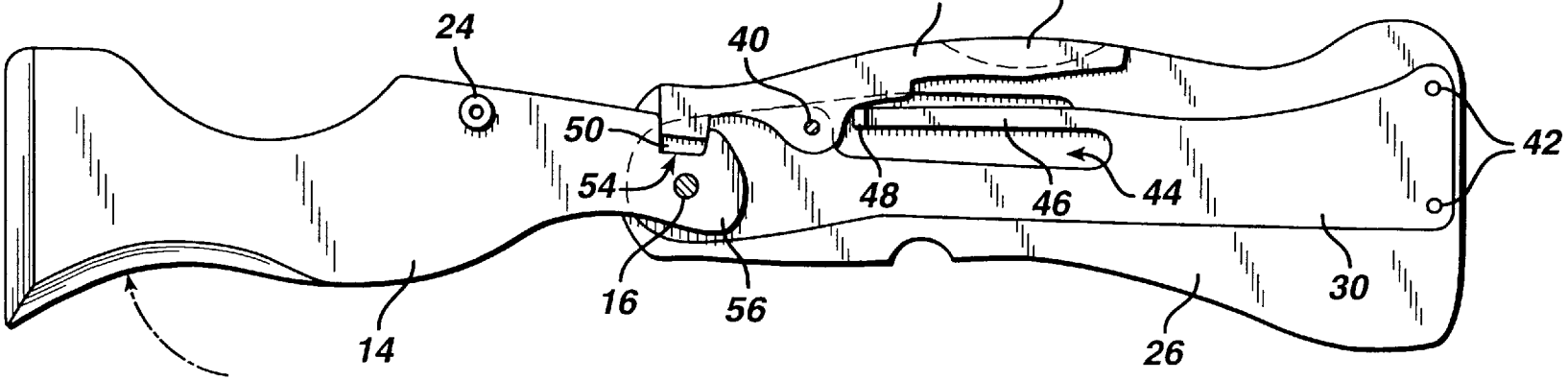

Blade 14 may be moved to the extended position, i.e., from the FIG. 4 to the FIG. 5 position, by grasping knob 24 and rotating blade 14 about pivot pin 16 in a clockwise direction. During such movement of the blade, tab 50 of the locking lever 32 is maintained by the biasing force of the beam spring 46 in contact with blade portion 56. When blade 14 reaches the fully extended or open position, locking lever 32 is rotated by the spring 46 to insert tab 50 in slot 54, as shown in FIG. 5, thereby preventing movement of blade 14 away from the open position.

Figure 6:
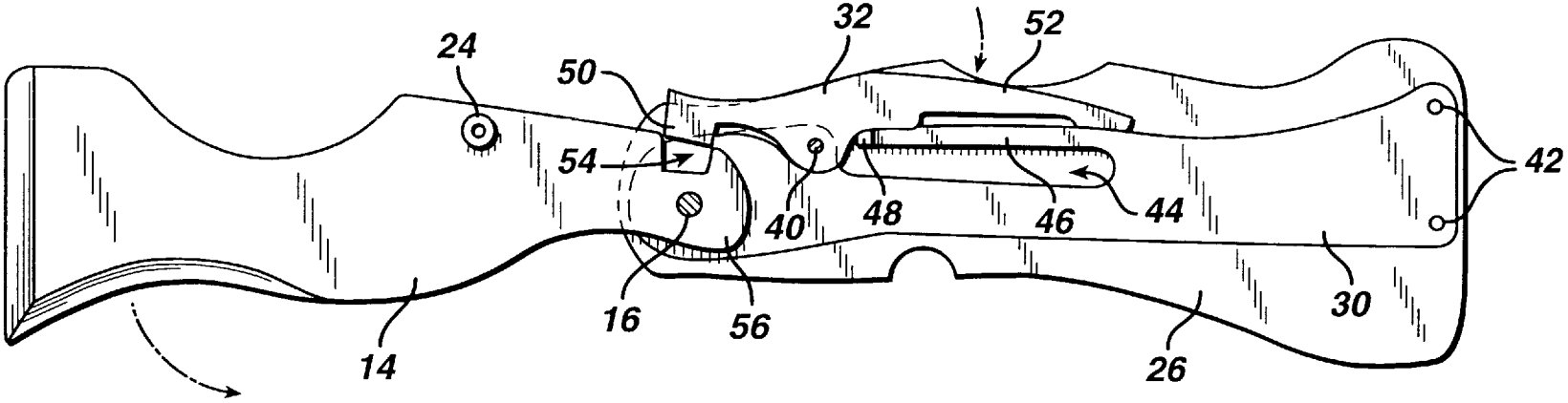
Figure 7:
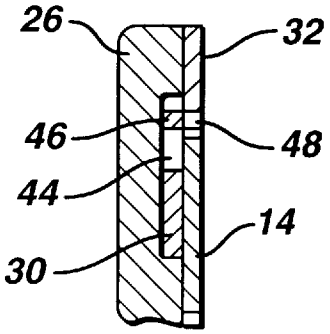
FIG. 7 is a fragmentary, end elevational view in section on the line 7—7 of FIG. 4.

In order to return blade 14 to the folded position, manual pressure is exerted on portion 52 of locking lever 32 to rotate the latter in a clockwise direction sufficiently to remove tab 50 from slot 54, as shown in FIG. 6. Such rotation of lever 32 is, of course, against the biasing force of the beam spring 46. After a small amount of counterclockwise rotation of blade 14, manual pressure on locking lever 32 may be released. The spring pressure will then maintain tab 50 in contact with rounded end portion 56 of blade 14 as the latter is returned to the folded position of FIG. 4.

From the foregoing it is apparent that the invention provides a hand tool with a folding implement which is locked in the open position until manually released, in the manner of prior art lockback knives, with fewer parts and in a smaller space than previously required. From this it follows that the tool of the present invention is generally lighter in weight, more compact and of lesser cost than previous counterpart tools having the same capabilities and functions. The liner and integral spring are preferably of tempered steel, providing strength and reinforcement to the handle cover piece, permitting the latter to be molded in thinner dimensions than would otherwise be possible.

It should also be understood that, although the disclosed embodiment has a single folding blade, the invention encompasses a tool having two blades. In such case, a second liner with integral beam spring would be disposed in a recess in the other handle cover, and a second locking lever would be pivotally mounted between the second blade and liner. A thin dividing plate would normally be position between the two blades, as in multi-blade, prior art knives of the lockback type, although the necessary frictional barrier could be provided simply by placing thin washers on the pivot pins of the blades and, if desired, the locking lever pivot pin.

What is claimed is:

1. A hand tool comprising:

a) a handle having a pair of substantially parallel, spaced cover pieces each having an inwardly and an outwardly facing surface;

b) at least one implement pivotally connected to said handle for movement with respect thereto between a folded position, wherein a majority of said implement is positioned between said cover pieces, and an open position, wherein a majority of said implement extends outwardly from said handle, said implement having a locking slot adjacent the pivotal connection thereof;

c) a substantially flat, metal liner of predetermined thickness and outline having a body portion fixedly attached to and having a surface area at least about half the area of said inwardly facing surface of one of said cover pieces, and a cantilevered arm extending integrally from said body portion to a terminal end portion, said arm being flexible in the manner of a beam spring in response to pressure on said end portion;

d) a locking lever pivotally connected to said handle and having first and second portions on opposite sides of its pivotal connection, said first portion contacting said end portion to flex said beam spring, whereby the latter exerts a biasing force tending to rotate said locking lever in a first direction, and said second portion including a locking tab movable into said locking slot by rotation of said lever in said first direction upon movement of said implement to said open position; and e) said inwardly facing surface of said one cover piece including a recess and said body portion and cantilevered arm of said liner are positioned in said recess.

2. The hand tool of claim 1 wherein said recess has a depth substantially equal to said predetermined thickness.

3. The hand tool of claim 1 wherein said recess has a peripheral outline substantially identical to said predetermined outline.

4. The hand tool of claim 1 wherein said terminal end portion extends laterally from said cantilevered arm and is positioned out of said recess, between said inwardly facing surfaces of said cover pieces.

5. The hand tool of claim 4 wherein said implement is mounted to said handle by a first pin extending through said liner and said implement and into both of said cover pieces.

6. The hand tool of claim 5 wherein said locking lever is mounted to said handle by a second pin, parellel to said first pin, extending through said liner and said locking lever and into both of said cover pieces.

7. The hand tool of claim 6 wherein said implement and said locking lever lie between spaced first and second planes parallel to one another and to said cover piece inwardly facing surfaces.

8. The hand tool claim 7 wherein said first and second planes are closely adjacent said inwardly facing surfaces.

9. In a hand tool having a handle including a pair of handle cover pieces with spaced, facing, inner surfaces of substantially equal areas and opposite ends, a blade pivotally movable between folded and extended positions with respect to said handle and a locking lever pivotally movable between locking and unlocking positions with respect to said blade when the latter is in said extended and folded positions, respectively, the improvement comprising:

a substantially flat, metal liner having a surface area at least about half of said equal areas, a body portion fixedly attached to one of said inner surfaces and a cantilevered arm extending integrally from said body portion to a terminal end portion extending laterally from said arm and bearing against said locking lever with said arm acting as a cantilever spring urging said lever toward rotation to said locking position, said metal liner being slotted to provide an open area between one side of said arm and said body portion.

10. The hand tool according to claim 9 wherein said inner surface of at least one of said cover pieces surrounds a recess wherein said liner is positioned.

11. The hand tool according to claim 10 wherein said recess has a substantially planar base surface.

12. The hand tool according to claim 11 wherein said recess has a depth substantially equal to the thickness of said liner whereby a surface of said liner is substantially coplanar with said one cover piece inner surface.

13. The hand tool according to claim 12 wherein said arm is elongated in a direction extending from its integral connection to said body portion, having substantially parallel side edges.

14. The hand tool according to claim 13 wherein one of said side edges borders said open area and the other of said side edges forms a portion of the periphery of said liner.

* * * * *